US006155820A

United States Patent [19]

Döbbeling et al.

[11] Patent Number: 6,155,820

[45] Date of Patent: Dec. 5, 2000

[54] BURNER FOR OPERATING A HEAT GENERATOR

[75] Inventors: Klaus Döbbeling, Windisch; Hans Peter Knöpfel, Besenbüren; Thomas Ruck, Mellingen, all of Switzerland

[73] Assignee: ABB Research Ltd., Zurich, Switzerland

[21] Appl. No.: 09/192,531

[22] Filed: Nov. 17, 1998

[30] Foreign Application Priority Data

Nov. 21, 1997 [EP] European Pat. Off. ..... 97810894

[51] Int. Cl.[7] ..... F23D 14/46

[52] U.S. Cl. ..... 431/350; 431/351; 431/285; 431/174; 431/178; 431/278; 239/403; 239/568

[58] Field of Search ..... 431/350, 351, 431/352, 353, 8, 175, 285, 174, 278; 239/403, 568

[56] References Cited

U.S. PATENT DOCUMENTS

| | | | |
|---|---|---|---|
| 5,127,821 | 7/1992 | Keller | 431/8 |
| 5,169,302 | 12/1992 | Keller | 431/350 |
| 5,193,995 | 3/1993 | Keller et al. | 431/351 |
| 5,284,437 | 2/1994 | Aigner | 431/351 |
| 5,375,995 | 12/1994 | Dobbeling et al. | 431/8 |
| 5,433,596 | 7/1995 | Dobbeling | 431/351 |
| 5,461,865 | 10/1995 | Snyder et al. | 60/737 |
| 5,482,457 | 1/1996 | Aigner et al. | 431/351 |
| 5,569,020 | 10/1996 | Griffin et al. | 431/7 |
| 5,588,824 | 12/1996 | McMillan | 431/351 |
| 5,735,687 | 4/1998 | Knopfel et al. | 431/354 |
| 5,921,766 | 7/1999 | Dobbeling et al. | 431/350 |
| 5,944,511 | 8/1999 | Ruck | 431/351 |

FOREIGN PATENT DOCUMENTS

| | | |
|---|---|---|
| 0433790A1 | 6/1991 | European Pat. Off. . |
| 0710797A2 | 5/1996 | European Pat. Off. . |
| 0724114A2 | 7/1996 | European Pat. Off. . |
| 0747635A2 | 12/1996 | European Pat. Off. . |
| 0780629A2 | 6/1997 | European Pat. Off. . |
| 0807787A2 | 11/1997 | European Pat. Off. . |
| 19545310A1 | 6/1997 | Germany . |
| 19548851A1 | 7/1997 | Germany . |

*Primary Examiner*—Ira S. Lazarus
*Assistant Examiner*—David Lee
*Attorney, Agent, or Firm*—Burns, Doane, Swecker & Mathis, L.L.P.

[57] ABSTRACT

In a burner for operating a heat generator, which burner essentially comprises a swirl generator (100), a transition piece (200) arranged downstream of the swirl generator, and a mixing tube (20), transition piece (200) and mixing tube (20) form the mixing section of the burner, this mixing section being arranged upstream of a combustion space (30). In the region of the tangential combustion-air-directing inflow ducts (101*b*–104*b*), fuel-directing ducts (121–124), the cross section of flow of which is designed for a low-calorific fuel (116), extend along the swirl generator (100). The fuel-directing ducts (121–124) end at a distance upstream of the transition of the tangential inflow ducts (101*b*–104*b*) into an interior space of the swirl generator (100), whereby partial mixing between the two media (115, 117) takes place before the mixture flows into the interior space (118). In addition, this setting-back provides sufficient space for other fuel-directing lines (111–114) in this region.

19 Claims, 4 Drawing Sheets

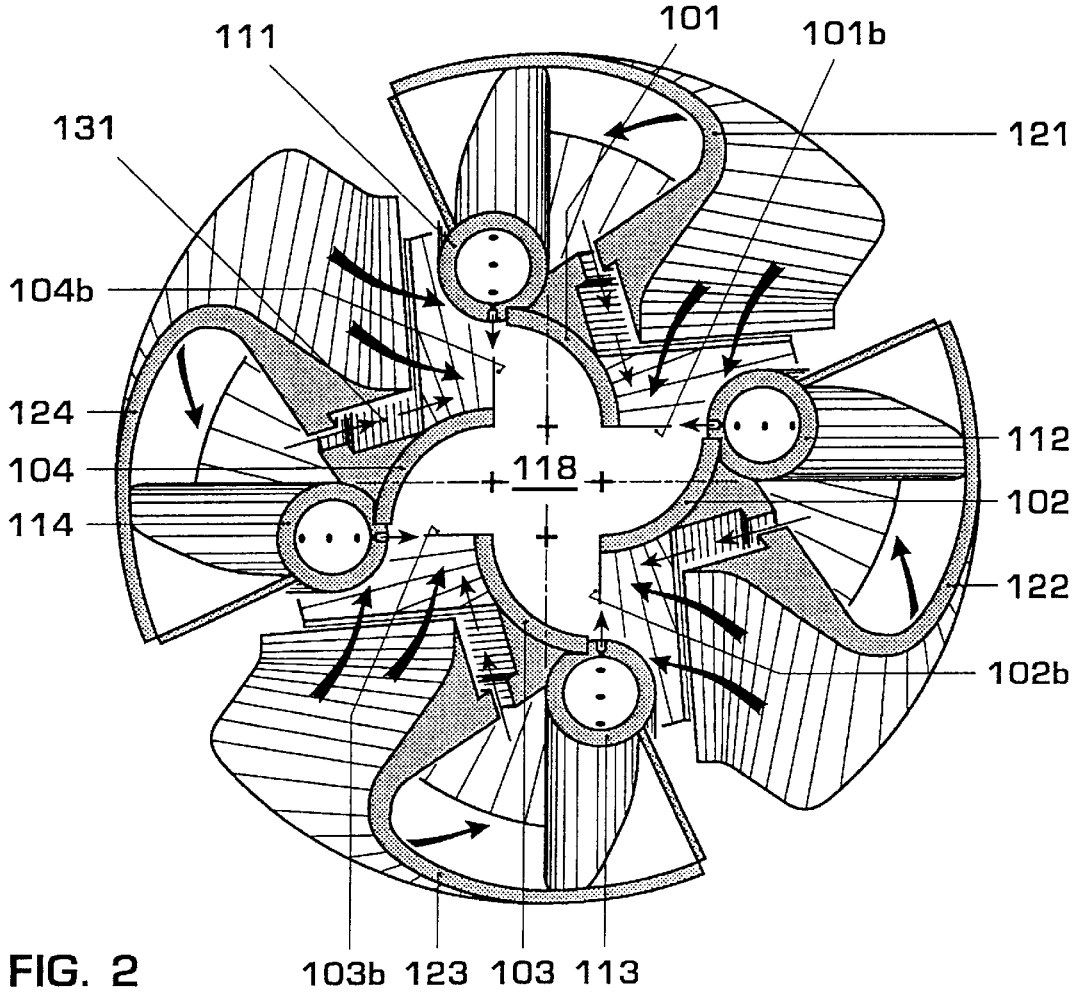
FIG. 2
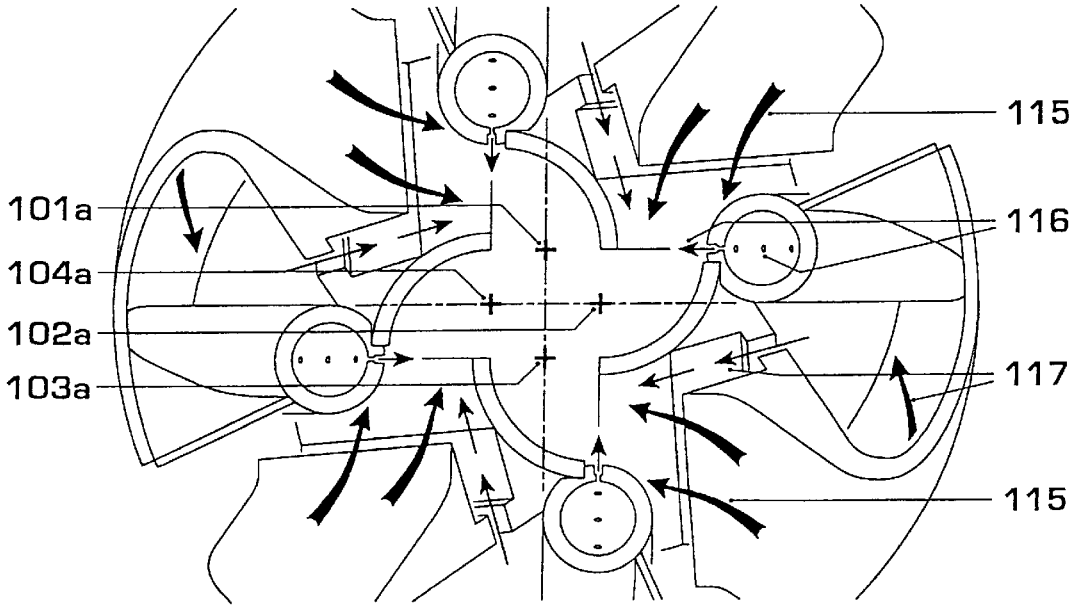

BURNER FOR OPERATING A HEAT GENERATOR

BACKGROUND OF THE INVENTION

1. Field of the Invention

The present invention relates to a burner for operating a heat generator according to the preamble of claim 1.

2. Discussion of Background

EP-0 780 629 A2 has disclosed a burner which consists of a swirl generator on the incident-flow side, the flow formed herein being passed over smoothly into a mixing section. This is done with the aid of a flow geometry, which is formed at the start of the mixing section for this purpose and consists of transition passages which cover sectors of the end face of the mixing section, in accordance with the number of acting sectional bodies of the swirl generator, and run helically in the direction of flow. On the outflow-side of these transition passages, the mixing section has a number of prefilming bores, which ensure that the flow velocity along the tube wall is increased. This is then followed by a combustion chamber, the transition between the mixing section and the combustion chamber being formed by a jump in cross section, in the plane of which a backflow zone or backflow bubble forms. The swirl intensity in the swirl generator is therefore selected in such a way that the breakdown of the vortex does not take place inside the mixing section but further downstream, as explained above, in the region of the jump in cross section. Here, the swirl generator performs the function of a premix section. The latter consists of at least two hollow, conical sectional bodies which are nested one inside the other in the direction of flow, the respective longitudinal symmetry axes of the individual sectional bodies running mutually offset. As a result, the adjacent walls of the sectional bodies form inflow ducts, tangential in their longitudinal extent, for a combustion-air flow, at least one fuel nozzle acting in the interior space formed by the sectional bodies.

Although this burner, compared with those from the prior art, guarantees a significant improvement with regard to intensification of the flame stability, lower pollutant emissions, lower pulsations, complete burn-out, large operating range, good cross-ignition between the various burners, compact type of construction, improved mixing, etc., it has been found that, when fuels having a lower calorific value, so-called low-calorific fuels, namely MBTU and LBTU gases, are injected through the fuel nozzles along the air-inlet ducts, the gas supply pressure greatly increases, which is reflected in a lower efficiency of the plant, here a gas turbine. Furthermore, since these fuels have high $H_2$ and CO portions, the flame velocity greatly increases, whereby there is the risk of the flame flashing back into the burner. In such a configuration, the burner changes to a diffusion mode, which then inevitably leads to high $NO_x$ emissions. In addition, there is then the inherent risk that the burner threatens to overheat or that parts thereof may be burnt off. In burners belonging to the prior art, the fuel is therefore injected as far downstream as possible, so that the flame cannot flash back upstream. Here, the fuel is often diluted with steam or with nitrogen, although the efficiency is then reduced in both cases.

SUMMARY OF THE INVENTION

Accordingly, one object of the invention, as defined in the claims, in a burner of the type mentioned at the beginning, is to propose novel measures which ensure good mixing during the use of a low-calorific fuel, at minimized pollutant emissions and maximized efficiency.

For this purpose, the swirl generator, in addition to the air-inlet ducts, is given a second independent fuel guide, preferably designed as a duct, through which the low-calorific fuel is fed. The latter is then admixed with the combustion-air flow in an adequate manner, specifically in such a way that the two media are partly mixed before they flow into the further interior space of the swirl generator.

The essential advantages of the invention may be seen in the fact that such a burner can now be used for any fuel. If, for example, the burner according to the invention is operated with a liquid fuel, the nozzle arranged on the head side is preferably used, the mode of operation of which is apparent from the publication mentioned at the beginning. During operation with a gaseous fuel of higher calorific value, the fuel nozzles which are arranged along the tangential inflow ducts at the transition to the interior space are used. And when a fuel of low calorific value is used, the extension according to the invention comes into play. This extension of the operation of the burner with a low-calorific fuel is possible, since the injection of the latter into the combustion air takes place at a distance upstream of the transition to the interior space of the swirl generator.

According to the invention, good partial mixing between the low-calorific fuel and the combustion air is ensured.

A further advantage of the invention may be seen in the fact that the fuel can be injected in an isokinetic manner, whereby considerable turbulence between the injected fuel and the combustion-air flow is prevented, whereby a flashback of the flame is permanently suppressed.

Advantageous and expedient developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 shows a section through the plane II—II of the swirl generator, with an additional stylized view for the purpose of defining the positions.

DESCRIPTION OF THE PREFERRED EMBODIMENTS

Figure 1:
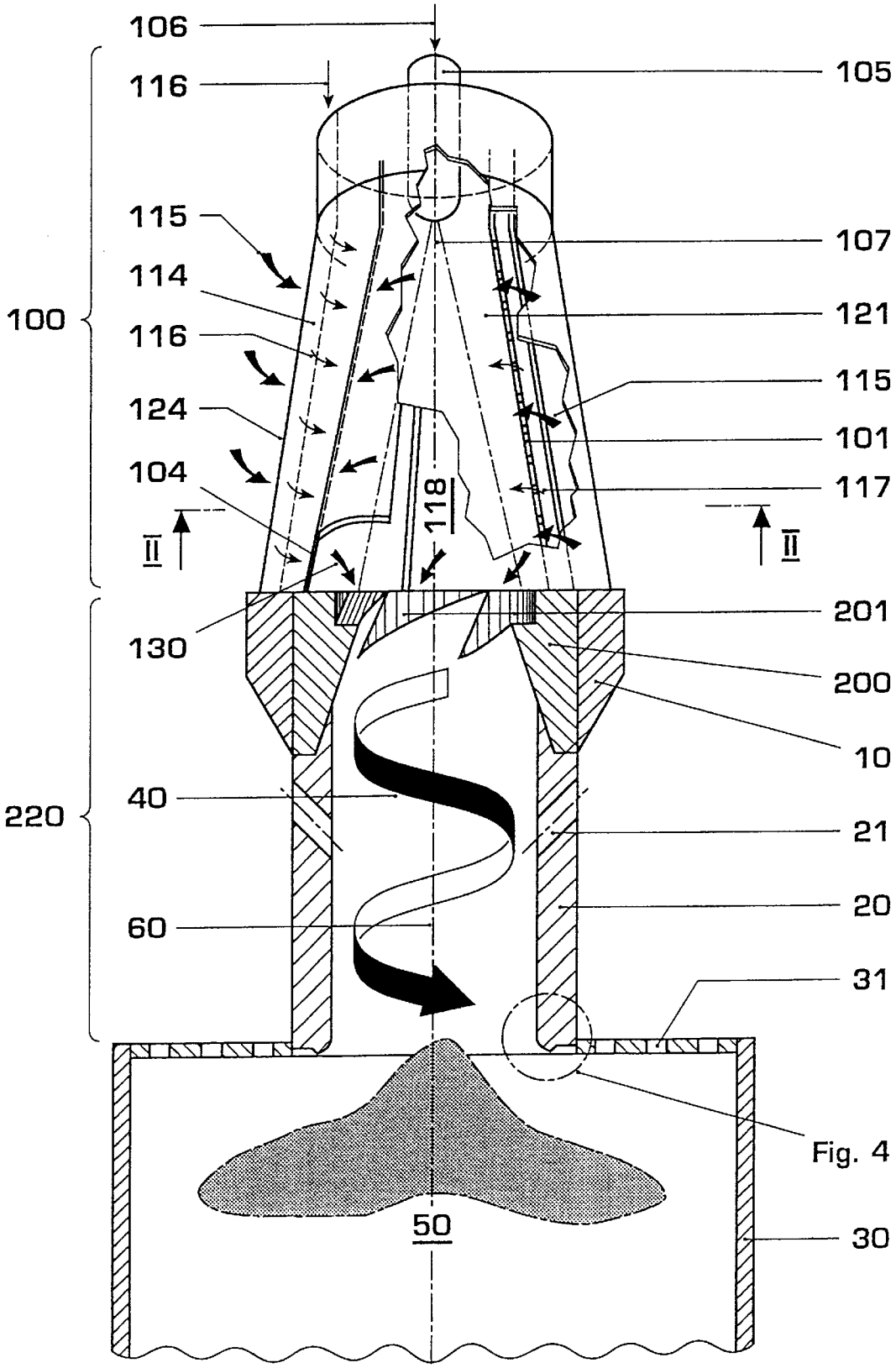
FIG. 1 shows a burner designed as a premix burner and having a mixing section downstream of a swirl generator.

Referring now to the drawings, wherein like reference numerals designate identical or corresponding parts throughout the several views, all features not essential for the direct understanding of the invention have been omitted, and the direction of flow of the media is indicated by arrows, FIG. 1 shows the overall construction of a burner. Initially a swirl generator 100 is effective, the configuration of which can be seen in more detail in connection with FIG. 2. The swirl flow forming in this swirl generator 100, with the aid of a transition geometry provided downstream of the latter, is passed over smoothly into a transition piece 200 in such a way that no separation regions can form in this zone. The configuration of this transition geometry is described in more detail with reference to FIG. 3.

The swirl generator 100 is described below with reference to FIG. 2. This swirl generator 100 consists of four hollow conical sectional bodies 101, 102, 103, 104 (cf. FIG. 2) which are nested one inside the other in a mutually offset manner. The mutual offset of the respective center axis 101*a*–104*a* (cf. FIG. 2) provides, on each side, a tangential inflow duct 101*b*–104*b* (cf. FIG. 2) through which combustion air 115 flows into the interior space 118 of the swirl generator 100. The conical shape of the sectional bodies 101–104 shown has a certain fixed angle in the direction of flow. Of course, depending on the operational use, the sectional bodies 101–104 may have increasing or decreasing conicity in the direction of flow, similar to a trumpet or tulip respectively. The two last-mentioned shapes are not shown graphically, since they can readily be visualized by a person skilled in the art. The sectional bodies 101–104 have a cylindrical initial part, the configuration of which is described in more detail with reference to FIG. 5. Of course, the swirl generator 100 may be designed to be entirely conical, that is, without the cylindrical initial part. The sectional bodies 101–104 each have a duct 121, 122, 123 124 (cf. also FIG. 2) which is offset inward and likewise directed tangentially, and fed through said ducts 121, 122, 123, 124 is a gaseous fuel 117, which is injected into the tangential, combustion-air-directing inflow ducts 101*b*–104*b* in each case via an axially running inflow slot 131, which extends parallel to or virtually parallel to the profile of the sectional bodies 101–104. The cross section of flow and the profile of this inflow slot 131 is adapted to the pressure and the quantity of the fuel 117 to be introduced. The two flows, namely the combustion air 115 and the gaseous fuel 117, are directed independently until their initial mixing, which takes place before the inflow of the same into the interior space 118. In this case, the fuel 117 is admixed with the combustion air 115 at a distance upstream of the transition of the tangential inflow ducts 101*b*–104*b* into the interior space 118. This achieves a situation in which the two media have already been premixed before entry into the interior space 118. Constructionally, this can be achieved by the fuel-directing ducts 121–124 being superimposed on the respective sectional bodies 101–104 as independent guides. The throughflow openings of the two media 115, 117 up to the plane of their mixing are designed in such a way that they permit the throughflow of an approximately uniform mass flow, which is always necessary if the burner is operated with an LBTU gas or an MBTU gas. In the present case, the gaseous fuel 117 flows out of the gas-directing ducts 121–124, as already mentioned, via the inflow slots 131 on the inside of the combustion-air flow 115. As mentioned, the mixing plane lies at a distance upstream of the transition of the tangential inflow ducts 101*b*–104*b* into the interior space 118. Thus a premixed mixture 130 flows into the interior space 118. Of course, the directing of the flow of the media 115, 117 may be changed around. The mixing of these two media before entry into the interior space 118 is effected by the shearing forces which mutually form there, a factor which results in quite intensive partial mixing. The further premix section into the swirl generator 100 then provides for the final provision of an optimum homogeneous mixture between the two media 115, 117. If the combustion air 115 is additionally preheated or enriched with a recycled exhaust gas, this provides lasting assistance for the degree of mixing of the two media. Narrow limits per se are to be adhered to in the configuration of the conical sectional bodies 101–104 with regard to the cone angle and the width of the tangential inflow ducts so that the desired flow field of the mixture can develop at the outlet of the swirl generator 100.

Furthermore, the swirl generator 100 is provided with a central fuel nozzle 105, which acts as a head stage. This fuel nozzle is preferably operated with a liquid fuel 106. However, it is also possible to operate this nozzle with a gaseous fuel. When a liquid fuel 106 is introduced via the nozzle 105, a conical fuel profile 107 forms in the conical hollow space 118 and is encased by the combustion air 115, which flows in tangentially and with a swirl. The combustion air 115 flowing in here can be replaced by the mixture 115/117 described above. The concentration of the fuel 106 is continuously reduced in the axial direction by the inflowing combustion air 115 to form a mixture. Even when a liquid fuel 106 is used via said nozzle 105, the optimum, homogeneous concentration over the cross section is achieved at the end of the swirl generator 100. It may also be concluded here that, if the combustion air 115 is preheated or enriched with a recycled exhaust gas, an increase in the vaporization of the liquid fuel 106 results.

Furthermore, the swirl generator 100 has a fuel line 111–114 along each of the tangential inflow ducts 101*b*–104*b*, through which fuel line 111–114 a fuel 116 flows, this fuel being injected into the combustion-air flow 115 at the transition to the interior space 118 via openings integrated in the fuel line. The burner can be operated with fuel from the lines 111–114, since the tangential fuel-directing ducts 121–124 do not extend up to the transition into the interior space 118 of the swirl generator 100.

Concerning the introduction of the fuels 106, 116, reference is made to publication EP-0 321 809 B1, which constitutes an integral part of the present description. The introduction of the low-calorific fuel 117 into the combustion-air flow 115 can be improved by flow aids (not shown in any more detail in the figures). Priority is given here to guide blades, which are arranged, for example, in the inflow slot 131 and thus channel the low-calorific fuel, whereby improved partial mixing results.

The number of conical sectional bodies 101–104 is not restricted to four. Swirl generators with merely two tangential inflow ducts are also possible.

The transition piece 200 is extended on the outflow side of the transition geometry (cf. FIG. 3) by a mixing tube 20, both parts forming the actual mixing section 220. The mixing section 220 may of course be made in one piece; i.e. the transition piece 200 and the mixing tube 20 are then fused to form a single cohesive structure, the characteristics of each part being retained. If transition piece 200 and mixing tube 20 are made from two parts, these parts are connected by a sleeve ring 10, the same sleeve ring 10 serving as an anchoring surface for the swirl generator 100 on the head side. In addition, such a sleeve ring 10 has the advantage that various mixing tubes can be used without having to change the basic configuration in any way. Located on the outflow side of the mixing tube 20 is the actual combustion space 30 of a combustion chamber, which is shown here merely by a flame tube. The mixing section 220 largely fulfills the task of providing a defined section, in which perfect premixing of fuels of various types can be achieved, downstream of the swirl generator 100. Furthermore, this mixing section, that is primarily the mixing tube 20, enables the flow to be directed free of losses so that at first no backflow zone or backflow bubble can form even in interaction with the transition geometry, whereby the mixing quality for all types of fuel can be influenced over the length of the mixing section 220. However, this mixing section 220 has another property, which consists in the fact that, in the mixing section 220 itself, the axial velocity profile has a pronounced maximum on the axis, so that a flashback of the flame from the combustion chamber is not possible. However, it is correct to say that this axial velocity decreases toward the wall in such a configuration. In order also to prevent flashback in this region, the mixing tube 20 is provided in the flow and peripheral directions with a number of regularly or irregularly distributed bores 21 having widely differing cross sections and directions, through which an air quantity flows into the interior of the mixing tube 20 and induces an increase in the rate of flow along the wall for the purposes of a prefilmer. These bores 21 may also be designed in such a way that effusion cooling also appears at least in addition at the inner wall of the mixing tube 20. Another possibility of increasing the velocity of the mixture inside the mixing tube 20 is for the cross section of flow of the mixing tube 20 on the outflow side of the transition passages 201, which form the transition geometry already mentioned, to undergo a convergence, as a result of which the entire velocity level inside the mixing tube 20 is raised. In the figure, these bores 21 run at an acute angle relative to the burner axis 60. Furthermore, the outlet of the transition passages 201 corresponds to the narrowest cross section of flow of the mixing tube 20. Said transition passages 201 accordingly bridge the respective difference in cross section without at the same time adversely affecting the flow formed. If the measure selected initiates an intolerable pressure loss when directing the tube flow 40 along the mixing tube 20, this may be remedied by a diffuser (not shown in the figure) being provided at the end of this mixing tube. A combustion chamber (combustion space 30) then adjoins the end of the mixing tube 20, there being a jump in cross section, formed by a burner front 70, between the two cross sections of flow. Not until here does a central flame front having a backflow zone 50 form, which backflow zone 50 has the properties of a bodiless flame retention baffle relative to the flame front. If a fluidic marginal zone, in which vortex separations arise due to the vacuum prevailing there, forms inside this jump in cross section during operation, this leads to intensified ring stabilization of the backflow zone 50. At the end face, the combustion space 30, provided this location is not covered by other measures, for example by pilot burners, has a number of openings 31 through which an air quantity flows directly into the jump in cross section and there, inter alia, helps to intensify the ring stabilization of the backflow zone 50. In addition, it must not be left unmentioned that the generation of a stable backflow zone 50 requires a sufficiently high swirl coefficient in a tube. If such a high swirl coefficient is undesirable at first, stable backflow zones may be generated by the feed of small, intensely swirled air flows at the tube end, for example through tangential openings. It is assumed here that the air quantity required for this is approximately 5–20% of the total air quantity. As far as the configuration of the burner front 70 at the end of the mixing tube 20 for stabilizing the backflow zone or backflow bubble 50 is concerned, reference is made to the description in connection with FIG. 4.

Figure 3:
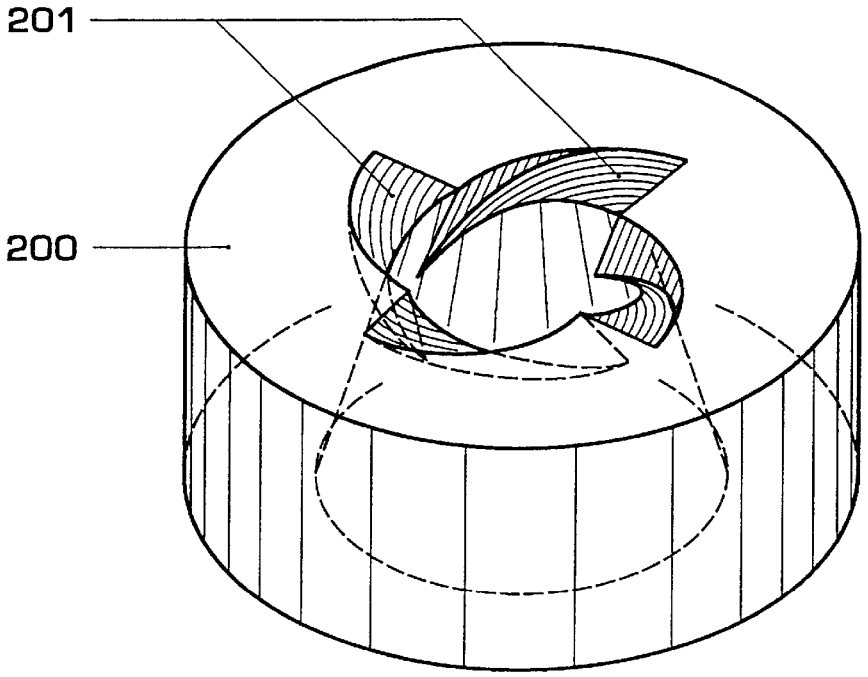
FIG. 3 shows a configuration of the transition geometry between swirl generator and mixing section.

FIG. 3 shows the transition piece 200 in a three-dimensional view. The transition geometry is constructed for a swirl generator 100 having four sectional bodies in accordance with FIGS. 1, 2. Accordingly, the transition geometry has four transition passages 201 as a natural extension of the sectional bodies acting upstream, as a result of which the cone quadrant of said sectional bodies is extended until it intersects the wall of the mixing tube. The same considerations also apply when the swirl generator is constructed from a principle other than that described with reference to FIGS. 1, 2. The surface of the individual transition passages 201 which runs downward in the direction of flow has a form which runs spirally in the direction of flow and describes a crescent-shaped path, in accordance with the fact that in the present case the cross section of flow of the transition piece 200 widens conically in the direction of flow. The swirl angle of the transition passages 201 in the direction of flow is selected in such a way that a sufficiently large section subsequently remains for the tube flow up to the jump in cross section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube produce a distinct increase in the axial-velocity profile toward the center of the mixing tube, so that the risk of premature ignition is decisively counteracted.

Figure 4:
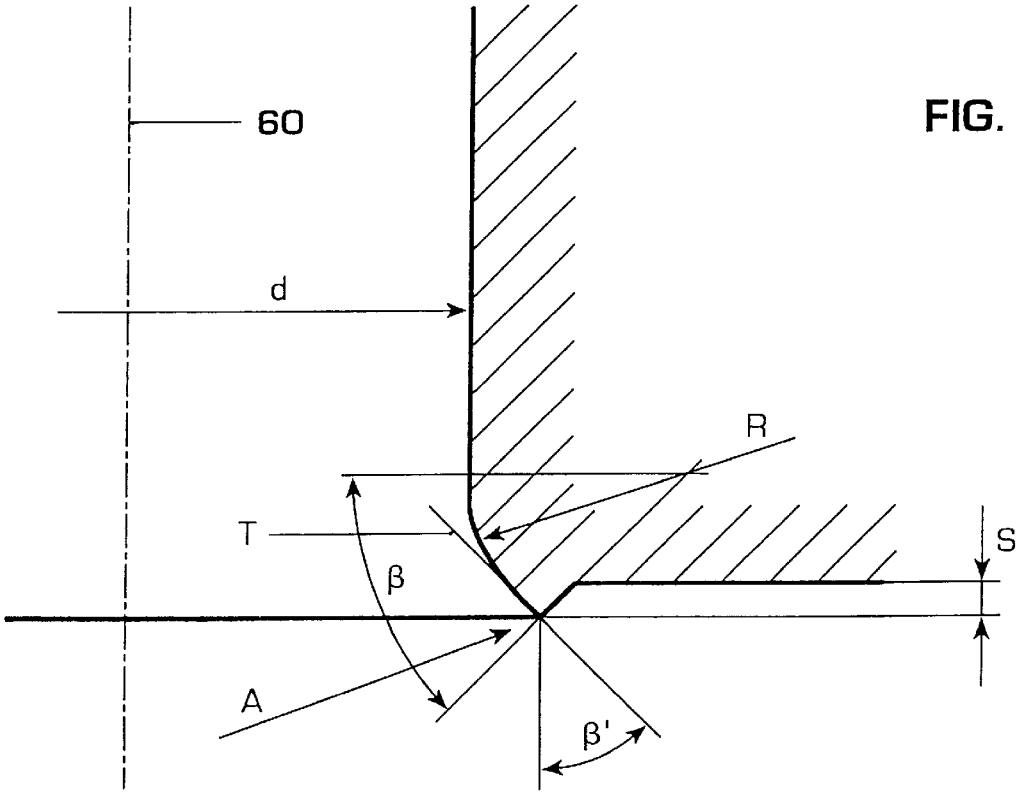
FIG. 4 shows a breakaway edge for the spatial stabilization of the backflow zone.

FIG. 4 shows the breakaway edge already discussed, which is formed at the burner outlet. The cross section of flow of the tube 20 in this region is given a transition radius R, the size of which in principle depends on the flow inside the tube 20. This radius R is selected in such a way that the flow comes into contact with the wall and thus causes the swirl coefficient to increase considerably. Quantitatively, the size of the radius R can be defined in such a way that it is>10% of the inside diameter d of the tube 20. Compared with a flow without a radius, the backflow bubble 50 is now hugely enlarged. This radius R runs up to the outlet plane of the tube 20, the angle β between the start and end of the curvature being>90°. The breakaway edge A runs along one leg of the angle β into the interior of the tube 20 and thus forms a breakaway step S relative to the front point of the breakaway edge A, the depth of which is>3 mm. Of course, the edge running parallel here to the outlet plane of the tube 20 can be brought back to the outlet-plane step again by means of a curved path. The angle β' which extends between the tangent of the breakaway edge A and the perpendicular to the outlet plane of the tube 20 is the same size as angle β. The advantages of this design of this breakaway edge can be seen from EP-0 780 629 A2 under the section "SUMMARY OF THE INVENTION". A further configuration of the breakaway edge for the same purpose can be achieved with torus-like notches on the combustion-chamber side. As far as the breakaway edge is concerned, this publication, including the scope of protection there, is an integral part of the present description.

Figure 5:
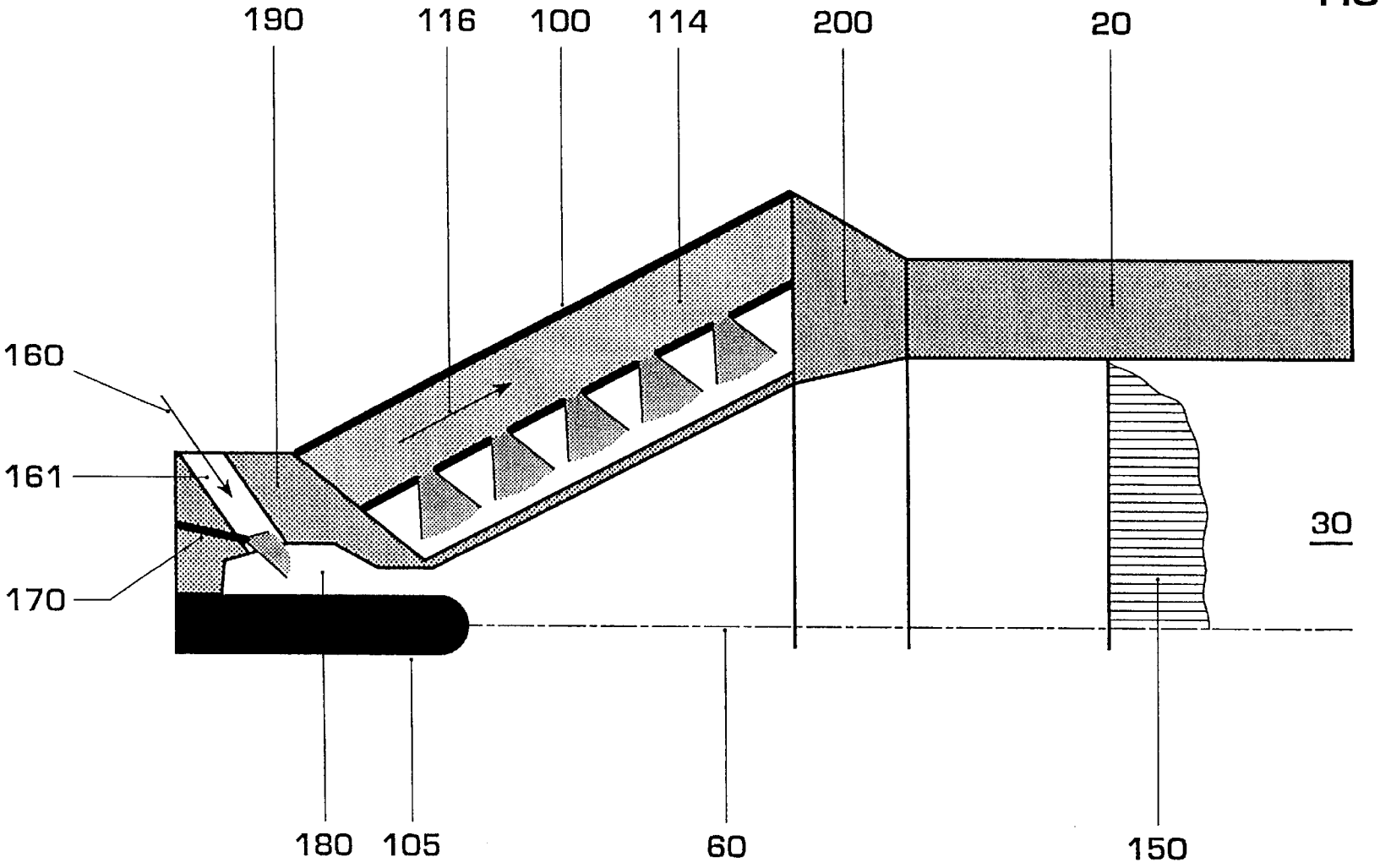
FIG. 5 shows a schematic representation of the burner according to FIG. 1 with additional fuel injectors.

FIG. 5 shows a schematic view of the burner according to FIG. 1, reference being made here in particular to the purging around a centrally arranged fuel nozzle 105 and to the action of fuel injectors 170. The mode of operation of the remaining main components of the burner, namely swirl generator 100 and transition piece 200, has already been described in more detail further above. The fuel nozzle 105 is encased at a distance by a ring 190 in which a number of bores 161 disposed in the peripheral direction are placed, and an air quantity 160 flows through these bores 161 into an annular chamber 180 and performs the purging there around the fuel lance. These bores 161 are positioned so as to slant forward in such a way that an appropriate axial component is obtained on the burner axis 60. Provided in interaction with these bores 161 are additional fuel injectors 170 which feed a certain quantity of preferably a gaseous fuel into the respective air quantity 160 in such a way that an even fuel concentration 150 appears in the mixing tube 20 over the cross section of flow, as the representation in the figure is intended to symbolize. It is precisely this even fuel concentration 150, in particular the pronounced concentration on the burner axis 60, which provides for stabilization of the flame front at the outlet of the burner to occur, whereby the occurrence of combustion-chamber pulsations is avoided.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for preparing a fuel and air mixture for combustion in a heat generator, the burner having a fluid flow direction and comprising a swirl generator having at least two sectional bodies, each sectional body including a tangentially acting inflow duct for the inflow of a combustion-air flow, said tangentially acting inflow duct being oriented so that the flow of the combustion-air is tangent to the fluid flow of the burner, means for injecting at least one fuel into the combustion-air flow, a mixing section being arranged downstream of the swirl generator and having, inside a first part of the mixing section in the direction of the fluid flow, a plurality of transition passages for passing the fluid flow formed in the swirl generator into a mixing tube arranged downstream of these transition passages, wherein a gas fuel-directing duct running in parallel or virtually in parallel to one of said sectional bodies is arranged in fluid communication with at least one tangentially acting inflow duct, and wherein the gas fuel-directing duct ends at a distance greater than zero upstream of the combustion-air flow from the tangentially acting inflow duct into an interior space of the swirl generator.

2. The burner as claimed in claim 1, wherein the fuel-directing duct ends with an inflow slot leading into the at least one tangentially acting inflow duct.

3. The burner as claimed in claim 2, wherein the inflow slot is provided with means for aiding a fluid flow from the fuel-directing duct to the at least one tangentially acting inflow duct.

4. The burner as claimed in claim 1, wherein the at least two sectional bodies are conical and hollow, and are nested one inside the other in the direction of the fluid flow of the swirl generator, wherein respective longitudinal symmetry axes of the sectional bodies run mutually offset in such a way that adjacent walls of the sectional bodies form inflow ducts which are tangential in their longitudinal extent, for the inflow of a combustion-air flow into the interior space of said swirl generator, and wherein further fuel nozzles can be positioned within said burner to take effect in the interior space of said swirl generator formed by the sectional bodies.

5. The burner as claimed in claim 1, wherein the burner can be operated with a low-calorific gaseous fuel via the fuel-directing duct, with a high-calorific gaseous fuel via fuel lines along the transition of the tangential inflow ducts into the interior space of said swirl generator, and with a liquid fuel via a fuel nozzle arranged centrally on an upstream end of the swirl generator.

6. The burner as claimed in claim 4, wherein the sectional bodies have a fixed cone angle, increasing conicity in the direction of fluid flow of the burner.

7. The burner as claimed in claim 4, wherein the sectional bodies are nested spirally one sectional body inside the other sectional body.

8. The burner as claimed in claim 4, wherein the fuel nozzle arranged on a downstream end of said swirl generator is encased by a concentric ring, wherein this ring has a number of bores arranged in a peripheral direction of the ring for injecting a further fuel into an air quality.

9. The burner as claimed in claim 8, wherein the bores are directed so as to slant forward.

10. The burner as claimed in claim 8, wherein the fuel nozzle is surrounded by an annular air chamber.

11. The burner as claimed in claim 1, wherein the number of transition passages in the mixing section corresponds to the number of sectional bodies forming the swirl generator.

12. The burner as claimed in claim 1, wherein the mixing tube arranged downstream of the transition passages is provided with openings for injecting an air flow into the interior of the mixing tube in the fluid flow direction of the burner.

13. The burner as claimed in claim 12, wherein the openings run at an acute angle relative to a central, axial burner axis of the mixing tube.

14. The burner as claimed in claim 1, wherein the cross sectional area of the fluid flow along a central, axial burner axis of the mixing tube downstream of the transition passages is less than the cross sectional area of the fluid flow along the central, axial burner axis formed in the swirl generator.

15. The burner as claimed in claim 1, wherein a combustion space is arranged downstream of the mixing section, wherein there is a stepped increase in cross sectional area along the central, axial burner axis between the mixing section and the combustion space, which stepped increase in cross sectional area induces the initial cross sectional area of a fluid flow of the combustion space, and wherein a backflow zone of the fluid flow of the combustion space can take effect in the region of the stepped increase in cross sectional area.

16. The burner as claimed in claim 1, wherein the mixing tube has a breakaway edge on an end adjacent to the combustion space.

17. The burner as claimed in claim 4, wherein the sectional bodies have a fixed cone angle, decreasing conicity in the direction of fluid flow of the burner.

18. The burner as claimed in claim 1, wherein the cross sectional area of the fluid flow along a central, axial burner axis of the mixing tube downstream of the transition passages is equal to the cross sectional area of the fluid flow along the central, axial burner axis formed in the swirl generator.

19. The burner as claimed in claim 1, wherein the cross sectional area of the fluid flow along a central, axial burner axis of the mixing tube downstream of the transition passages is greater than the cross sectional area of the fluid flow along the central, axial burner axis formed in the swirl generator.

* * * * *